US005689947A

United States Patent [19]

Yoo

[11] Patent Number: 5,689,947

[45] Date of Patent: Nov. 25, 1997

[54] WATCH CHAIN

[76] Inventor: Tae Woo Yoo, 807, 1-Dong, Hanyang, Apt. 32-5, Banpo-dong, Seocho-ku, Seoul, Rep. of Korea

[21] Appl. No.: 745,784

[22] Filed: Nov. 8, 1996

[30] Foreign Application Priority Data

Jul. 19, 1996 [KR] Rep. of Korea ..... 96-21268

[51] Int. Cl.[6] ..... F16G 13/00

[52] U.S. Cl. ..... 59/80; 59/82; 59/78; 63/4

[58] Field of Search ..... 59/78, 80, 82; 63/4

[56] References Cited

U.S. PATENT DOCUMENTS 3,965,671 6/1976 Kodera ..... 59/80

FOREIGN PATENT DOCUMENTS 96-6881 8/1996 Rep. of Korea .

286210 2/1953 Switzerland ..... 59/80

*Primary Examiner*—David Jones

*Attorney, Agent, or Firm*—Richard M. Goldberg

[57] ABSTRACT

A watch chain includes first and second sets of linked bases, each base including a body, a pair of parallel, curved, extending portions connected to opposite edges of the body, a projection positioned on a concave bottom of each extended portion for applying a finger-pressure, a beam fixedly mounted to and extending between ends of the extended portions, and an elliptical shaped arm having one end connected with the body and being movable between a raised position for inserting the beam of a second base between the arm and the body, and a folded position to fix the beam of the second base between the arm and the first body; a lock member connected to one end of the first set of linked bases; and a link member connected to one end of the second set of linked bases, with opposite ends of the first and second sets of linked bases being connectable to a watch.

7 Claims, 3 Drawing Sheets

WATCH CHAIN

BACKGROUND OF THE INVENTION

1. Field of the Invention

The present invention relates to a watch chain and more particularly this invention has a projection for applying finger-pressure.

2. Description of the Prior Art

In general, a watch having various forms; such as a metal and leather band, has been attached with a watch. All watch chains have the functions of holding a watch on the wrist and an ornament of a watch. In views of a recent trend of requesting that a watch chain have special functions as well an ornamental function, this invention was created.

SUMMARY OF THE INVENTION

The object of the present invention is to provide a watch chain which can have a function of being worn as a watch, have an ornamental effect and have an effect of a finger-pressure in connection with the blood relationship of the wrist.

According to the invention, to accomplish the above object, there is provided a watch chain which includes first and second sets of linked bases, each base including a body, a pair of parallel extending portions connected to opposite edges of the body, a projection positioned on a bottom of each extended portion for applying a finger-pressure, a beam fixedly mounted to and extending between ends of the extended portions, and an arm having one end connected with the body and being movable between a raised position for inserting the beam of a second base between the arm and the body, and a folded position to fix the beam of the second base between the arm and the first body; a lock member connected to one end of the first set of linked bases; and a link member connected to one end of the second set of linked bases.

BRIEF DESCRIPTION OF THE DRAWINGS

The objects and features of the present invention will be hereinafter explained in detail with reference to the accompanying drawings, wherein.

DESCRIPTION OF THE PREFERRED EMBODIMENTS

Figure 1:
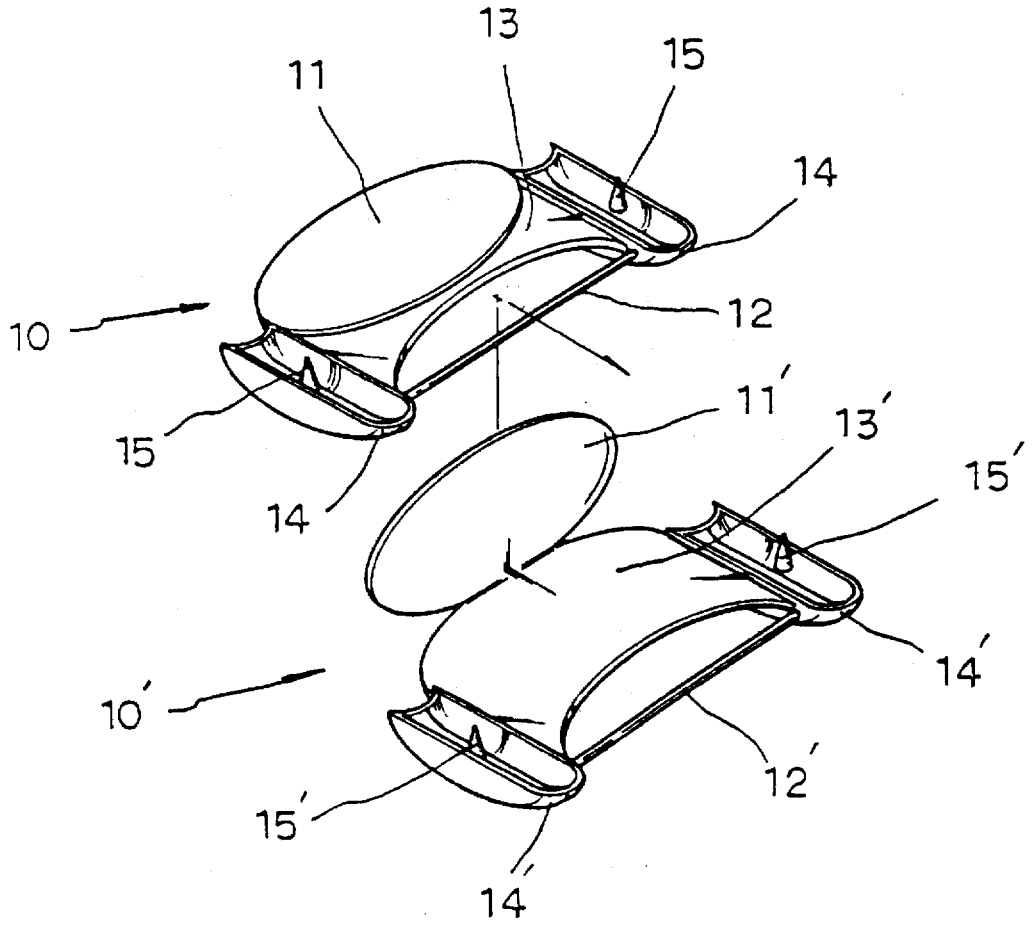
FIG. 1 is a separated perspective view of the bottom of two bases.
Figure 2:
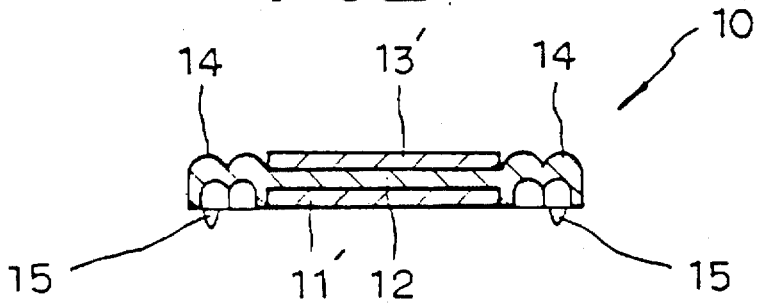
FIG. 2 is a connected sectional view of the bases.
Figure 3:
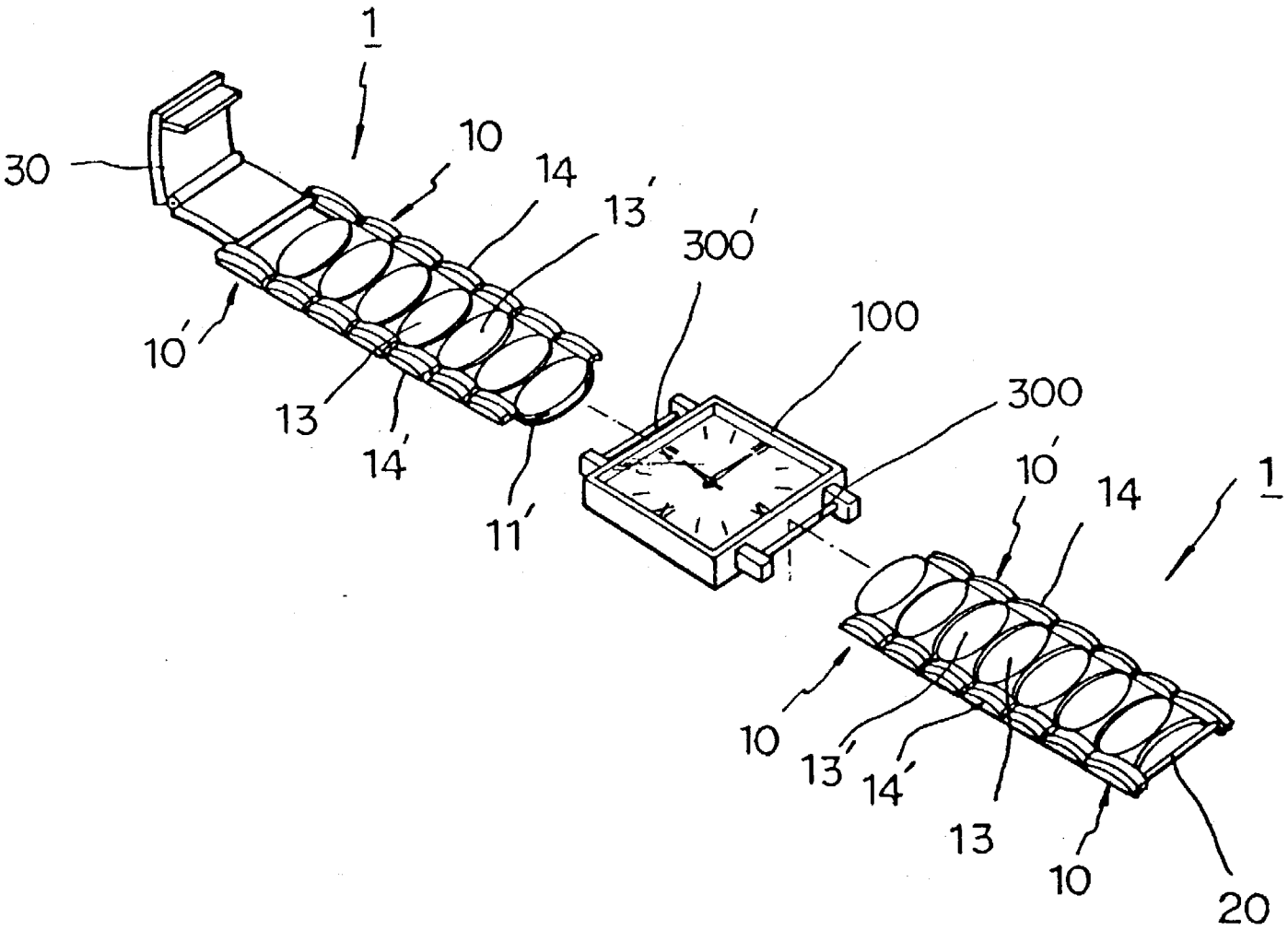
FIG. 3 is a perspective view of the entire watch chain.
Figure 4:
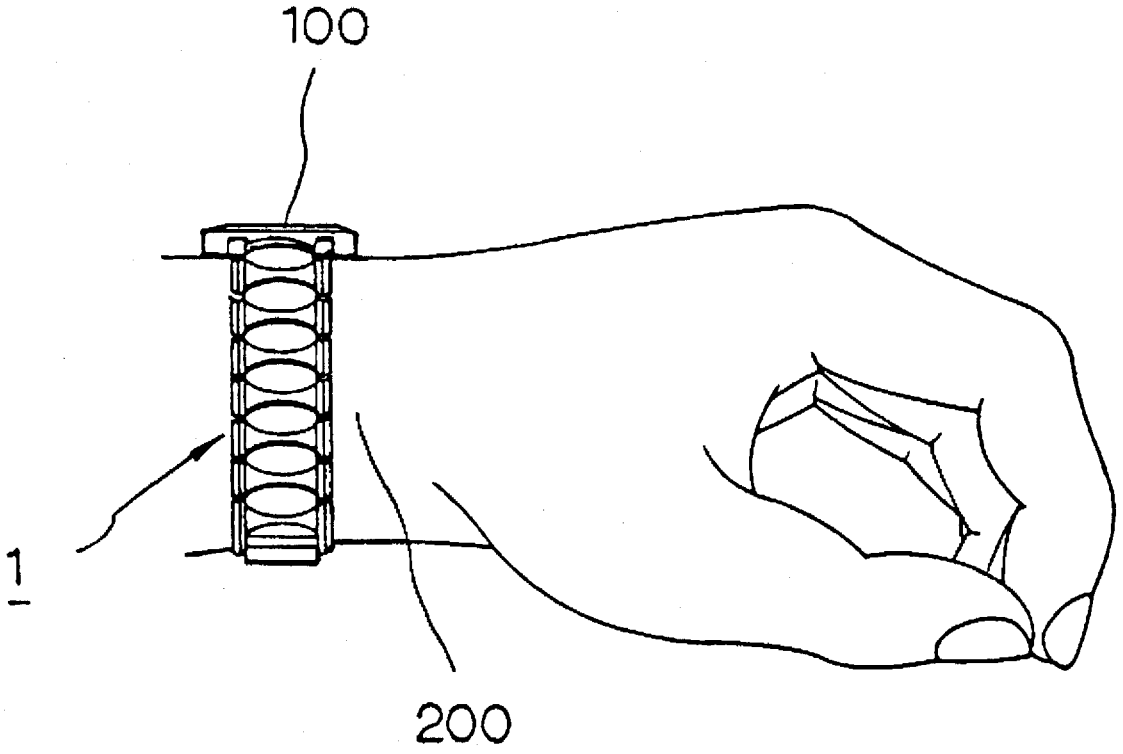
FIG. 4 is an elevational view of wearing the watch having the watch chain.

As shown FIG. 1, the unfolded or raised arm 11' is inserted to the beam or rod 12 of another base 10 and then is folded or pivoted.

A plurality of the bases 10,10' which are connected to the base 10 continuously are united to form chain 1.

One set of end arms 11,11' of the chains 1 are connected to a lock member 30 and a link member 20, and the other set of end arms 11,11' of the chains are inserted to the joined rods, 300' of a watch 100.

Then, the watch 100 which is connected to the watch chains 1 can be worn as a wristwatch.

In wearing the wristwatch, the projections 15,15' which are positioned on the bottom of the extended portions 14,14' which are parallel and positioned at both edges of the body 13 stimulate and apply pressure to the wrist.

Therefore, the projections have effects of finger-pressure in connection with blood circulation by applying finger-pressure to the skin of the wrist and being an ornament by having the extended portion of a curved shape and the arm of an elliptical shape.

As mentioned above, this invention provides a watch chain having a special effect, by providing each base with the elliptical shape arm and the curved extended portions of the body and having the projection in the bottom of each extended portion, in wearing the watch which has the watch chain, thus having an effect of finger-pressure in connection with blood circulation as well as checking a time.

What is claimed is:

1. A watch chain comprising:

first and second sets of linked bases, each base including:

a first body, a pair of parallel extending portions connected to opposite edges of the body, a projection positioned on a bottom of at least one extended portion for applying a finger-pressure, a beam fixedly mounted to and extending between ends of the extended portions, and an arm having one end connected with the body and being movable between a raised position for inserting the beam of a second base between said arm and said first body, and a folded position to fix the beam of the second base between said arm and said first body;

a lock member connected to one end of the first set of linked bases; and a link member connected to one end of the second set of linked bases.

2. A watch chain according to claim 1, wherein opposite ends of said first and second sets of linked bases are connectable to a watch.

3. A watch chain according to claim 1, wherein a said projection is positioned on the bottom of both extended portions of each base for applying a finger-pressure.

4. A watch chain according to claim 1, wherein each projection is positioned substantially centrally of the respective extended portion.

5. A watch chain according to claim 1, wherein each said extended portion is formed in an inverted trough shaped configuration, with a concave surface as an undersurface and a concave surface as an upper exposed surface, and said projection is mounted to said concave surface.

6. A watch chain according to claim 1, wherein each said extended portion has a convex end and an opposite concave end, with the concave ends of the extended portions of said first base facing the convex ends of the extended portions of the second base.

7. A watch chain according to claim 1, wherein each said arm has an elliptical shape.

* * * * *